United States Patent [19]

Dorer, Jr.

[11] Patent Number: 4,666,461

[45] Date of Patent: May 19, 1987

[54] FUEL TREATMENT COMPOSITIONS

[75] Inventor: Casper J. Dorer, Jr., Lyndhurst, Ohio

[73] Assignee: The Lubrizol Corporation, Wickliffe, Ohio

[21] Appl. No.: 820,478

[22] Filed: Jan. 17, 1986

Related U.S. Application Data

[60] Continuation of Ser. No. 603,006, Apr. 23, 1984, abandoned, which is a division of Ser. No. 345,299, Feb. 3, 1982, abandoned.

[51] Int. Cl.[4] ..... C10L 1/22

[52] U.S. Cl. ..... 44/63; 44/71; 44/76; 544/110; 544/177; 252/389.2

[58] Field of Search ..... 544/110, 177; 260/925, 260/922; 252/389 A; 44/63, 71, 76

[56] References Cited

U.S. PATENT DOCUMENTS 2,988,434 6/1961 Gottshall et al. ..... 44/72

*Primary Examiner*—Mrs. Y. Harris-Smith

*Attorney, Agent, or Firm*—Forrest L. Collins; Joseph P. Fischer; Denis A. Polyn

[57] ABSTRACT

Corrosion inhibiting additive compositions for use in alcohol and alcohol containing normally liquid hydrogen fuels derived by the reaction of at least one phosphoric acid reactant and at least one amine selected from the group consisting of morpholines and alkanolamines and alcohol and alcohol containing normally liquid hydrocarbon fuels containing said additive compositions are disclosed.

8 Claims, No Drawings

FUEL TREATMENT COMPOSITIONS

This is a continuation of co-pending application Ser. No. 603,006 filed on Apr. 23, 1984, which is a divisional of Ser. No. 345,299 filed Feb. 3, 1982 both now abandoned.

FIELD OF THE INVENTION

This invention relates to corrosion inhibiting compositions for use in alcohol and alcohol containing normally liquid hydrocarbon fuels. This invention further relates to alcohol and alcohol containing normally liquid hydrocarbon fuels containing said corrosion inhibiting compositions and characterized by improved corrosion inhibition.

BACKGROUND OF THE INVENTION

Alcohol fuels and alcohol containing normally liquid hydrocarbon fuels for use in spark-ignited and compression-ignited internal combustion engines possess a high degree of corrosive activity. This higher activity is attributable to the reactive nature of alcohols in general and in some instances, such as for example ethenol, to the presence of acidic and halogen ion containing contaminants. Thus, alcohols are particularly destructive to various nonferrous metals and metal coatings, such as tin/lead alloy coatings employed on internal surfaces of fuel tanks and to zinc/aluminum alloys employed in the construction of carburetors. As a result, motor vehicles employing alcohol and alcohol containing normally liquid hydrocarbon fuels have shown a greater propensity toward corrosion in the fuel tank, fuel line, and fuel induction system areas.

Two patents which are specifically directed toward corrosion inhibition in alcohol or alcohol containing hydrocarbon fuel, e.g., gasohol, are U.S. Pat. Nos. 4,282,007 and 4,282,008. In the former are disclosed additives comprising the reaction products of aminotriazoles and polyisobutenyl succinic anhydride and in the latter reaction products of an amineotriazole, isatoic anhydride and N-alkylpropylenediamine.

It is an object of this invention to provide other corrosion inhibiting additives for use in alcohol and alcohol normally liquid hydrocarbon fuels. It is a further object of this invention to provide alcohol and alcohol containing normally liquid hydrocarbon fuels containing said additives. It is yet a further object of this invention to provide alcohol and alcohol containing normally liquid hydrocarbon fuels characterized by improved corrosion inhibition. These and other objects are accomplished in accordance with the invention described hereinbelow.

SUMMARY OF THE INVENTION

In its broadest sense, the present invention relates to compositions for use in alcohol and alcohol containing normally hydrocarbonaceous petroleum distillate fuels, said compositions comprising a corrosion inhibiting reaction product of (A) at least one phosphoric acid compound having the formula

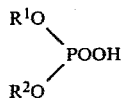

wherein $R^1$ is a hydrocarbon based radical containing from about 8 to about 18 carbon atoms and $R^2$ is hydrogen or a hydrocarbon based radical containing from about 8 to about 18 carbon atoms and (B) at least one amine compound selected from a group consisting of morpholines of the formula

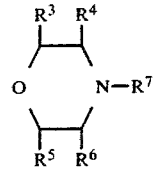

wherein $R^3$, $R^4$, $R^5$, and $R^6$ are independently hydrogen or alkyl radicals containing from 1 to about 3 carbon atoms and $R^7$ is hydrogen or a radical selected from the group consisting of hydrocarbon based radicals containing from 1 to about 20 carbon atoms and $—R^8O)_xR^9$ radicals where $R^8$ is divalent alkyl radical containing from 1 to about 20 carbon atoms, x is a number ranging from 1 to about 10 and $R^9$ is hydrogen or aliphatic radicals containing from 1 to about 6 carbon atoms and alkanolamines having the formula

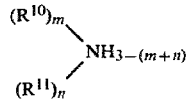

wherein $R^{10}$ is a hydrocarbon based radical containing from 2 to about 10 carbon atoms, said radical $R^{10}$ further containing at least hydroxyl group, $R^{11}$ is a hydrocarbon based radical containing from 1 to about 20 carbon atoms, m is a number equal to 1, 2, or 3, n is a number equal to 0, 1, or 2 and the sum of m+n is a number ranging from 1 to 2 to provide alcohol and alcohol containing normally liquid hydrocarbonaceous petroleum distaillate fuels with improved corrosion inhibition.

The invention further relates to compositions for use in internal combustion engines comprising (A) a major portion of a fuel containing (i) from about 2 to 100 percent by volume of an alcohol containing from 1 to about 5 carbon atoms and (ii) from about 98 to 0 volume percent of a normally liquid hydrocarbonaceous petroleum distillate fuel and (B) a minor portion of the corrosion inhibiting products generally described hereinabove.

DETAILED DESCRIPTION OF THE INVENTION

The corrosion inhibiting additives comprising one aspect of this invention are amine salts prepared by the reaction of phosphoric acids and monoamines, both of which are defined in detail below.

As used herein, the term "hydrocarbon based" or "hydrocarbon based radicals" denotes a radical having a carbon atom directly attached to the remainder of the molecule and having predominantly hydrocarbon character within the context of this invention. Such radicals include the following:

1. Hydrocarbon radicals; that is, aliphatic, (e.g. alkyl or alkenyl), alicyclic (e.g., cycloalkyl or cycloalkenyl), aromatic aliphatic- and alicyclic substitued aromatic, aromatic substituted aliphatic and alcyclic radicals, cyclic radicals wherein the ring is completed through another portion of the molecule (i.e., any two indicated substitutents may together form an alicyclic radical) and the like as well as two or more used benzene nuclei. Such radicals are know to those skilled inthe art, represented examples of which include methyl, ethyl, propyl, butyl, octyl, decyl, dodecyl, cyclohexyl, phenyl, tolyl, benzyl, napthyl, anthryl, phenanthryl and the like, and 2. Substituted hydrocarbon radicals; that is radicals containing non-hydrocarbon substitutents which, in the context of this invention do not alter the predominantly hydrocarbon character of the radical. Those skilled in the art will be aware of suitable substituents (hydroxy, alkoxy, carbalkoxy, etc.).

The phosphoric acids which are useful in the preparation of the amine salts in this invention are partially esterified orthophosphoric acids having the formula

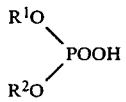

wherein $R^1$ is a hydrocarbon based radical containing from about 8 to about 18 carbon atoms and $R^2$ is hydrogen or a hydrocarbon radical containing from about 8 to about 18 carbon atoms. Thus, it is comtemplated that the phosphoric acids may be monoesters or diesters of orthophosphoric acids or mixtures thereof represented by the formulae

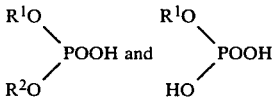

wherein $R^1$ and $R^2$ are hydrocarbon based radicals as defined above. For reasons of economy a mixture of mono- and diphosphate esters is preferred. Such a mixture can be prepared by the reaction of one mole of phosphorus pentoxide with three moles of a hydrocarbon alcohol having from about 8 to about 18 carbon atoms. The reaction may be illustrated by the following equation:

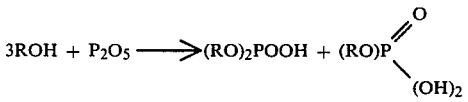

Alternatively, from about two to four moles of the hydrocarbon alcohol or a mixture of such alcohols can be employed per mole of the phosphorus pentoxide.

Generally, $R^1$ will be unsubstituted aliphatic radicals and preferably unsubstituted alkyl radicals such as, e.g., octyl, nonyl, decyl, undecyl, dodecyl, tridecyl, tetradecyl, hexadecyl, and octadecyl and $R^2$ will be hydrogen or $R^1$.

For the preparation of the phosphoric acids, the alcohol will be primary alcohol and preferably branched primary alcohol having from about 8 to about 18 carbon atoms. Examples of such alcohol are the normal alcohols derived from coconut kernel oils. One such commercially available fraction consists mainly of the n-octyl and ndecyl alcohols. Another consists largely of n-dodecyl alcohol, but contains others alcohols having from about 10 to about 18 carbon atoms. Preferably, the alcohol will be a mixture of branched-chain primary alcohols such as those produced by the well known "Oxo" process. Examples of such alcohols include the "Oxo" octyl, decyl, tridecyl, and octyldecyl alcohols, all of which are mixtures consisting predominantly of branched-chain primary alcohols obtained from propylene-butylene dimer, tri-propylene, tetra-propylene, and penta-propylene, respectively.

The amines, which are useful in preparing the corrosion inhibiting additive compositions which comprise one aspect of the present invention are monoamines selected from the group consisting of the group morphylenes of the formula

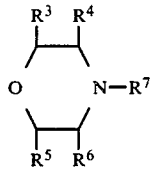

wherein $R^3$, $R^4$, $R^5$, and $R^6$ are independently hydrogen or alkyl radicals containing from 1 to about 3 carbon atoms and $R^7$ is hydrogen or a radical selected from the group consisting of hydrocarbon based radicals containing from 1 to about 20 carbon atoms and $—R^8O)_xR^9$ radicals where $R^8$ is a divalent aliphatic hydrocarbon radical containing from 1 to about 20 carbon atoms, x is a number ranging from 1 to about 10, and $R^9$ is hydrogen or an aliphatic hydrocarbon radical containing from 1 to about 6 carbon atoms, and akanolamines having the formula

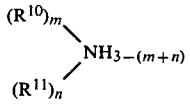

wherein $R^{10}$ is a hydrocarbon based radical containing from about 2 to about 10 carbon atoms, said radical $R^{10}$ further containing at least one hydroxyl group, $R^{11}$ is a hydrocarbon based radical containing from 1 to about 20 carbon atoms, m is a number equal to 1, 2, or 3, n is a number equal to 0, 1, or 2, and the sum of m+n is a number ranging from 1 to 3. In a preferred embodiment, the amine compounds useful in preparing the additive compositions described herein are selected from the group consisting morpholines of the above formula wherein $R^3$, $R^4$, $R^5$, and $R^6$ are all hydrogen atoms and $R^7$ is hydrogen or a radical selected from the group consisting of hydrocarbon based radicals containing from 1 to about 10 carbon atoms and $—R^8O)_xR^9$ radicals where $R^8$ is a divalent alkyl radical containing from 1 to about 10 carbon atoms, x is a number ranging from 1 to about 6 and $R^9$ is hydrogen or alkyl radical containing from 1 to about 3 carbon atoms and alkanolamines of the above formula wherein $R^{10}$ is an aliphatic hydrocarbon radical containing from about 2 to 5 carbon atoms, said radical $R^{10}$ containing at least one hydroxyl group, $R^{11}$ is a hydrocarbon based radical containing from 1 to about 10 carbon atoms, and m and n and the sum of m+n are as set forth above. The most preferred amine compounds is useful in preparing the additive compositions of this invention are morpholines having the following formula

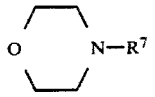

wherein $R^7$ is hydrogen or a radical selected from the group consisting of straight-chain or branched-chain aliphatic radicals containing from 1 to about 5 carbon atoms and $—R^8O)_xR^9$ radicals where $R^8$ is a divalent-alkyl radical containing from 1 to about 6 carbon atoms, x is a number ranging from 1 to about 4, and $R^9$ is hydrogen or alkyl radicals containing from 1 to about 3 carbon atoms and alkanolamine of the formula above wherein $R^{10}$ is a straight-chain or branched-chain alkyl radical containing from about 2 to 3 carbon atoms, said radical $R^{10}$ further containing one hydroxyl group, $R^{11}$ is a straight-chain or branched-chain alkyl radical containing from 1 to about 3 carbon atoms and m and n and the sum of m+n are the same as set forth above.

Represeptative, but non-limited examples of amine compounds useful in the preparation of the additive compositions comprising of one aspect of this invention and falling within the description of the amines set forth above are Morpholine, 4-methylmorpholine, 4-ethylmorpholine, 4-propylmorpholine, 4-butylmorpholine, 2-methylmorpholine, 2-ethylmorpholine, 2,5-dimethylmorpholine, 2-ethyl-5-methylmorpholine, 2,6-diethylmorpholine, 4-heptylmorpholine, 4-dodecylmorpholine, 4-hexyldecylmorpholine, 4-cyclohexylmorpholine, 4-cyclohexyl-2,6-dimethylmorpholine, 4-cyclopentylmorpholine, 4-(3-butenyl)morpholine, 4-(1-hexenyl)-morpholine, 4-(2-ethylhexyl)morpholine, 4-eicosylmorpholine, 4-(2-methoxy)morpholine, 4-(2-cyclohexyloxyethyl)morpholine, 4-(2-methoxymethyl)morpholine, 4-(2-methylpentyl)morpholine, 4-(3-methylthenyl)morpholine, 4-phenylmorpholine, 4-(2-phenylethyl)morpholine, monoethanolamine, diethanolamine, triethanolamine, monoisopropanolamine, diisopropanolamine, triisopropanolamine, mono-sec-butenylamine, di-sec-butenylamine, di-methylethanolamine, di-methylisopropanolamine, diethylethanolamine, methylethanolamine, butylethanolamine, phenylethanolamine, phenylethylethanolamine, methyldiethanolamine, tris(-hydroxy methyl) methylamine, and the like. The most preferred amines for use in preparing the additive compositions of this invention are selected from the group consisting of morpholine, ethylmorpholine, diethanolamine, and triethanolamine.

The amine salts comprising the corrosion inhibiting additive compositions of the present invention can be prepared simply by mixing the organic substituted phosphoric acid and the amine reactant at a temperature below about 100° C. The reaction in most instances is slightly exothermic and is preferably carried out in the presence of a solvent. Solvents which have been found to be useful are the hydrocarbons or polar salts, such as, benzene, naptha, toluene, xylene, n-hexane, dioxane, chlorobenzene, kerosene, or a fuel oil. Ordinarily, the relative proportions of the reactants used to prepare the salts are one equivalent of the phosphoric acid compound and one equivalent of the amine so that all of the free amino groups are converted to salts. In some instances, however, only one acidic hydrogen on a mono-organic substituted phosphoric acid may be utilized to form a salt. Thus, amine salts which are useful in this invention are prepared by reacting the amine with one to two equivalents of the phosphoric acid.

The following examples illustrate the preparation of the additive compositions comprising one aspect of this invention and improved corrosion characteristics of alcohol or alcohol containing normally liquid fuels containing these compositions. In the following examples, all parts are by weight unless otherwise specified.

EXAMPLE 1

A reaction vessel equipped with a stirrer, thermometer and reflux condenser is charged with 1000 parts (5.0 moles) tridecyl alcohol. The vessel is purged with nitrogen while the alcohol is heated to 35° C. Phosphorus pentoxide, 248 parts (1.74 moles), is added in increments over a period of 5 hours. The reaction is exothermic and the temperature is allowed to rise to 50° C. during the addition. The materials are then reacted at 60° C. for 8 hours. The reaction mixture is then filtered and collected. The product obtained contains 8.5 percent phosphorus.

EXAMPLE 2

To a solution of 14.8 parts of diethanolamine in 50 parts of xylene is added, over a period of one hour, 35.2 parts of the product of Example 1. The temperature of the reaction mixture rises exothermically from room temperature to 50° C. during the addition. The materials are then stirred for an additional 0.25 hour at 50° C.

EXAMPLE 3

To 18.7 parts of triethanolamine is added, over a period of one hour, 31.3 parts of the product of Example 1. The temperature rises exothermically from room temperature to 51° C. during the addition. Xylene, 50 parts, is then added and the materials are mixed at 50° C. for an additional 0.25 hour.

EXAMPLE 4

Following the procedure of Example 3, 9.85 parts of ethanolamine is reacted with 40.15 parts of the product of Example 1, and diluted with 50 parts xylene.

EXAMPLE 5

Following the procedure of Example 2, a solution consisting of 12.95 parts of morpholine and 50 parts xylene is reacted with 37.05 parts of the product of Example 1.

EXAMPLE 6

A series of alcohol fuels are prepared by blending from 10 to 450 parts by weight of one of the reaction products of examples 2 through 5 with one million parts by weight of hydrated ethanol containing about 7.5 percent by weight water.

EXAMPLE 7

A series of alcohol containing gasoline fuels is prepared by blending from 10 to 450 parts by weight of one of the reaction products of examples 2 through 5 with one million parts by weight of a gasohol which comprises 20 percent by volume of hydrated ethanol containing 7.5 percent by weight of water and 80 percent by volume of gasoline having an ASTM distillation range of from about 60° C. at the 10 percent distillation point to about 205° C. at the 90 percent distillation point.

The corrosion inhibiting effectiveness of the additive compositions were tested in accordance with Method K, Test C of the Brazilian Association of Technical Norms (ABNT). In this test, various metal specimens (e.g., steel, brass, zinc/aluminum alloys) are immersed in commercially available hydrated ethanol for a continuous period of 144 hours at a temperature of 50° C.±3° C. At the end of the test period each test specimen is then rinsed first with water and then with a ketone or other suitable solvent and dried. After drying, each test specimen is weighed and its visual appearance noted. The weight loss, if any, and visual appearance of the specimens are then compared to those of specimens treated in the same manner in a control or reference gasoline/alcohol blend comprised of 78 to 82 percent by volume of gasoline and 22 to 18 percent by volume of 100 percent absolute ethanol. For a corrosion inhibiting aoditive composition to be considered effective, neither the weight loss nor the visual appearance of specimens tested with additive containing hydrated ethanol can vary from those treated in the controlled or referenced gasohol/alcohol blend by more than 10 percent. The corrosion inhibiting additive compositions described in examples 2 through 5 above are found to be affective when tested in accordance with this Brazilian method.

Another aspect of this invention comprises fuel compositions for use in internal combustion engines comprising (A) a major portion of a fuel containing (i) at least one alcohol having from 1 to about 5 carbon atoms and (ii) a normally liquid hydrocarbonaceous petroleum distillate fuel and (B) a minor portion of a corrosion inhibiting reaction product as described hereinabove, i.e., the reaction product of (i) at least one phosphoric acid reactant having the formula as set forth hereinabove, and (ii) at least one amine reactant selected from the group consisting of morpholines and alkanolamines corresponding to the formulae also set forth hereinabove.

Alcohol fuels useful in combination with the corrosion inhibiting reaction products of phosphoric acids and amines as defined herein to provide fuel compositions having improved corrosion inhibiting characteristics include such commercially available alcohols as methanol, ethanol, propanol, isopropanol, butyl alcohol and its isomers and amyl alcohol and its isomers and mixtures of these various alcohols. As produced commercially, the preferred alcohols for use in the present invention are methanol and ethanol. The hydrated forms of the above alcohol are particularly suited for accomplishing the objectives of this invention.

The normally liquid hydrocarbonaceous petroleum distillate fuels which are useful in combination with alcohols and the corrosion in inhibiting reaction product as described hereinabove include motor gasoline as defined by (ASTM) Specification D439 and diesel fuel or fuel oil as defined by ASTM Specification D396. A particularly preferred petroleum distillate fuel, however, is gasoline, that is, a mixture of hydrocarbons having an ASTM distillation range of from about 60° C. at the 10 percent distillation point to about 205° C. at the 90 percent distillation point.

The fuel portion of the fuel composition of this invention comprise of about 2 to 100 percent by volume of at least one alcohol containing 1 to about 5 carbon atoms, and from about 98 to 0 percent by volume of the normally liquid hydrocarbonaceous petroleum distillate fuel. In a preferred embodiment, this fuel portion will comprise from about 10 to 100 percent by volume of at least one alcohol containing from 1 to about 5 carbon atoms and from 90 percent to 0 percent by volume of the petroleum distillate fuel. In a more preferred embodiment, the ranges of the alcohol and petroleum distillate fuels employed in the fuel compositions of this invention will be from about 20 to 100 percent by volume and from about 80 to 0 percent by volume respectively. Particularly useful fuel compositions are those based on a mixture of alcohol, especially methanol or ethanol, and a petroleum distillate fuel, especially gasoline, in which mixture the alcohol component component ranges from about 10 to about 20 percent by volume and the petroleum distillate fuel ranges from about 90 to 80 percent by volume.

The amount of the corrosion inhibiting reaction products disclosed herein, to be added to the above described fuel portion to provide the fuel compositions of this invention will be an amount sufficient to impart improved corrosion inhibitng characteristics to these fuel compositions. Broadly this amount will arrange from about 10 to 1,000 parts by weight of said additives reaction product per million part by weight of said fuel portion. Preferably this amount will range from about 10 to about 450 parts by weight with a range from about 175 to about 450 parts by weight of said additive reaction product per million parts by weight of said fuel portion being the most preferred. It is to be understood that these amounts are based on additive in pure form and not in a diluted form such as in a concentrate form as described below.

The fuel compositions of this invention can be prepared by merely adding the reaction product of the phosphoric acid and amine directly to the fuel portion or it can be diluted with a substantially inert normally liquid diluent such as naptha, benzene, toluene, xylene, or a petroleum distillate fuel as described above to form a concentrate of said reaction product which is then added to the fuel portion. These concentrates which constitute yet another embodiment of the invention generally contain from about 20 percent to about 90 percent of the additive reaction products.

The fuel compositions described hereinabove, may also contain additional materials normally added to liquid fuels to obtain specific benefits. Therefore, the fuel compositions which represent one aspect of this invention may also contain additional materials normally added to liquid fuels to obtain specific benefits. Therefore the fuel compositions which represent one aspect of this invention may contain anti-knock agents such as tetraalkyl lead compounds, lead scavengers such as halo alkanes (e.g., ethylene dichloride and ethylene dibromide) deposit preventers or modifiers such as triaryl phosphates, dyes, octane improvers, antioxidants such as 2,6-di-tertiarybutyl-4-methylphenol, bacteriostatic agents, gum inhibitors, metal deactivators, demulsifiers, dispersants, detergents, upper cylinder lubricants and anti-icing agents.

The compositions for use in alcohol and alcohol containing normally liquid hydrocarbonaceous petroleum distillate fuels and the fuel compositions based thereon as well as their methods of preparation have been specifically set forth above to assist those skilled in the art in understanding and practicing the invention. Based on the teachings herein, many various and departures from these specific disclosures will be obvious to those skilled in the art. Such varions and departures are contemplated as being within the scope and spirit of the present invention as defined by the appended claims.

What is claimed is:

1. A composition comprising the salt which is the reaction product of (A) at least one phosphoric acid compound having the formula $R^1O(R^2O)POOH$ wherein $R^1$ and $R^2$ are each a hydrocarbon based radical selected from the group consisting of decyl, undecyl, dodecyl, tridecyl, tetradecyl, pentadecyl, hexadecyl, heptadecyl and octadecyl and mixtures thereof, and (B) at least one compound having a morpholine structure, further provided (C) that the salt has corrosion inhibiting properties in a gasoline containing fuel.

2. The composition of claim 1 additionally comprising $R^1O(HO)POOH$.

3. The composition of claim 1 wherein the morpholine structure is

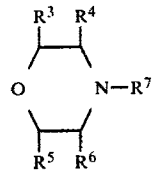

wherein $R^3$, $R^4$, $R^5$ and $R^6$ are independently hydrogen or alkyl radicals containing from 1 to 3 carbon atoms and $R^7$ is hydrogen or a radical selected from the group consisting of hydrocarbon based radicals containing from 1 to about 20 carbon atoms and $(R^8O)_xR^9$ where $R^8$ is a divalent aliphatic hydrocarbon radical containing from 1 to about 20 carbon atoms, x is a number ranging from 1 to about 10 and $R^9$ is hydrogen or an aliphatic hydrocarbon radical containing from 1 to about 6 carbon atoms.

4. The composition of claim 1 wherein component (B) is morpholine.

5. The composition of claim 1 wherein $R^1$ and $R^2$ are tridecyl.

6. The composition of claim 3 wherein $R^8$ is a divalent alkyl radical containing from 1 to about 6 carbon atoms, x is a number ranging from 1 to about 4 and $R^9$ is hydrogen or an alkyl radical containing from 1 to about 3 carbon atoms.

7. The composition of claim 1 containing a normally liquid hydrocarbonaceous petroleum distillate fuel.

8. The composition of claim 1 wherein the compound having the morpholine structure is morpholine, $R^1$ and $R^2$ are both tridecyl, and further comprising a major portion of a normally liquid hydrocarbon distillate fuel.

* * * * *